US006404983B1

(12) United States Patent
Gruzdev et al.

(10) Patent No.: US 6,404,983 B1
(45) Date of Patent: Jun. 11, 2002

(54) APPARATUS AND METHOD FOR HEAT GENERATION

(75) Inventors: Valentin A. Gruzdev, Moscow (RU); Pavel V. Efremkin, Ardsley, NY (US)

(73) Assignee: Future Energy Corp., Ardsley, NY (US)

( * ) Notice: Subject to any disclaimer, the term of this patent is extended or adjusted under 35 U.S.C. 154(b) by 0 days.

(21) Appl. No.: 09/617,856

(22) Filed: Jul. 17, 2000

Related U.S. Application Data

(63) Continuation-in-part of application No. 09/108,589, filed on Jul. 1, 1998, now Pat. No. 6,091,890.

(51) Int. Cl.[7] ..... F24H 1/10
(52) U.S. Cl. ..... 392/485; 432/219; 432/29
(58) Field of Search ..... 392/311–12, 465–466, 392/483, 485; 250/428–31; 126/344–45, 373, 380, 387, 263.07, 247, 255; 432/219, 29; 44/307, 302; 204/660; 376/100, 111, 156

(56) References Cited

U.S. PATENT DOCUMENTS 5,188,090 A 2/1993 Griggs
6,091,890 A * 7/2000 Gruzdev et al. ..... 392/485

FOREIGN PATENT DOCUMENTS

| | | |
|---|---|---|
| RU | 2054604 | 2/1996 |
| RU | 2061195 | 5/1996 |

OTHER PUBLICATIONS

International Application, PCT/US89/02998, Inventor: Clifford L. Ashbrook.

* cited by examiner

*Primary Examiner*—Teresa Walberg
*Assistant Examiner*—Thor Campbell
(74) *Attorney, Agent, or Firm*—Lawrence G. Fridman

(57) ABSTRACT

An apparatus for heat generation includes a vessel having a working chamber with a flow of working fluid passing therethrough. A source of pulsed light and a light-reflecting surface wettable by the working fluid are situated within the working chamber. A thermal energy is released into the working polar fluid by the pulsed light irradiation of the working fluid in the vicinity of the light-reflecting surface. The released thermal energy is continuously removed from the vessel by the flow of working fluid.

19 Claims, 4 Drawing Sheets

APPARATUS AND METHOD FOR HEAT GENERATION

This is a Continuation-in-Part Application of patent application Ser. No. 09/108,589, filed Jul. 1, 1998 now U.S. Pat. No. 6,091,890 which is currently pending.

FIELD OF THE INVENTION

The present invention relates to heat and power engineering and, more particularly, to a method and an apparatus for heating of fluids.

BACKGROUND OP THE INVENTION

There is known a method and apparatus for heat generation in the fluid, based on conversion of the kinetic energy of the flowing fluid into heat, as disclosed by U.S. Pat. No. 5,188,090 to Griggs.

This apparatus consists of an arrangement for forming a high-speed fluid jet and moderation thereof. The process of moderation is adapted for conversion of the jet kinetic energy into the heat energy accompanied by the fluid temperature increase.

Drawbacks of such known method and apparatus reside in the low values of the conversion of the energy delivered to a pump drive into the thermal energy of the fluid. In view of the pure mechanical nature of the used conversion principles, these values are not very high. The principles of this project are indifferent to physicochemical properties of the fluid used.

Another example of a method for generating energy is described in Russian Patent No. 2,054,604 issued Feb. 20, 1996. This method is based on the exposure of a fluid to the action of a combination of constant and alternating pressures, in certain ratios, leading to formation of cavitation bubbles in the fluid. Upon bursting, these bubbles convert their internal energy into the thermal energy of the fluid.

An apparatus for carrying out this method employs an ultrasonically-induced cavitator to exert alternating pressure.

These method and apparatus are similar to the above discussed and are applicable with different working fluids. It has been shown experimentally that the amount of the liberated thermal energy exceeds that of the initial energy delivered. This is explained by the fact that the heat energy release in the fluid depends on the course of nuclear reactions.

As a consequence, in accordance with the disclosure of this patent, the heat generation is accompanied by the ionizing radiation, specifically the neutron radiation, which significantly exceeds in quantity the level of natural radiation. Therefore, use of such method and apparatus is not environmentally safe. Moreover, the use of cavitation should often result in the destruction of the used apparatus.

There is also known a method of heat generation in the fluid disclosed by Russian Patent No. 2,061,195 issued May 27, 1996. This method is also based on the use of cavitation and is directed to increase the intensity of cavitation by forming a gas cushion in a fluid. Such cushion cavitates in a closed-loop system and by varying the volume of the gas cushion and varying fluid flow rate until self-excited conditions are established. An apparatus for carrying out this method comprises a hydraulic closed-loop system with an expanding container, a piston movable within the container, a centrifugal cavitator and a heat exchanger for supplying heat to a customer.

Important advantages of these method and apparatus are in the fact that the increase in heat generation results from improving intensity of the cavitation processes and is accompanied by the reduction of negative consequences of the cavitation on the operational life span of the structural elements of the apparatus. This is due to the fact that gas bubbles or cavities are formed mostly inside the fluid.

In view of the common physical principles utilized by Russian Patent No. 2,061,195 and the foregoing technical solutions, a possibility exists for creation of a system with high efficiency conversion of the delivered energy into a thermal energy of the fluid. However, in view of the above discussed common principles, the method and apparatus disclosed by Russian Patent No. 2,061,195 suffer from a substantial drawback. That is, environmental safety of its operation cannot be assured.

Furthermore, there is known a method described in the International application PCT WO 90/00526 (1990) consisting of formation of oppositely directed vortex streams of deionized water and causing such streams to collide at a high rate of flow. As indicated by the disclosure of this International application, the disagglomeration of water (which is the main object of the method), is accompanied by heating of water. Such heating is additional to the heat generation achieved as a result of conversion of the kinetic energy of flowing water.

An apparatus for carrying out the method disclosed in this PCT application consists of a colloidal mill containing a tank with oppositely positioned vortex nozzles included in a closed-loop system. The apparatus also contains a pumping arrangement and a heat exchanger for absorption of heat liberated in the fluid.

In the method and apparatus disclosed by PCT WO 90/00526, it is essential to use the unique properties of water causing energy release as a consequence of the breaking of hydrogen bonds. The necessity of employing the water as a working fluid restricts the scope of possible applications of such method and apparatus for the purposes of heat generation. Moreover, it is indicated in the disclosure of the International application PCT WO 90/00526 that, the heat energy generation is accompanied by the release of electrical energy. Since the latter takes place, apparently, through electromagnetic radiation, the environmental safety of these technical solutions is also questionable.

All technical solutions discussed hereinabove suffer from a common drawback residing in the fact that heat generation is associated with a preliminary conversion of the delivered energy into the kinetic energy of the fluid (see for example PCT application WO 90/00526). This leads to a considerable complexity of delivery of a heat-transfer fluid from a place of acquiring energy to a consumer.

SUMMARY OF THE INVENTION

It is, therefore, an object of the invention to provide a method and apparatus for heat generation.

A further object of the invention is to provide a method and apparatus for heat generation which are environmentally safe.

It is also an object of the invention to minimize the preliminary conversion of the delivered energy into the kinetic energy of the working fluid.

It is a further object of the invention to provide a method and apparatus capable of expanding the wide range of the used fluids.

In the method and apparatus of the present invention, a polar liquid is used as the working fluid. The polar working fluid is irradiated by a pulsed light radiation in a zone of contact or engagement between the working fluid and a light-reflecting screen or surface situated within the fluid. The screen or surface is made of a material wettable by the working fluid or formed with a coating made of such material.

Such combination of properties of the screen and the working fluid assures presence of immobile or slow-moving molecules in the vicinity of the screen. The light-reflecting properties of the screen enhance usage of the light radiation energy for separation of the immobile or slow moving molecules from the surface of the screen. The slow-moving molecules separated from the screen surface receive energy liberated in the formation of molecular clusters. Development of such clusters, in cases of spontaneous collisions of the molecules of the working fluid having greater mobility (or formations originated earlier) is caused by the polar properties attributable to the working fluid.

To increase the intensity of heat generation the working fluid can be irradiated by the pulsed light radiation generated by an extended source of such radiation.

In order to increase the total volume of the working fluid to be heated and also to enhance the usage of the generated heat, a part of the heated working fluid is removed from a zone of action by the pulsed light radiation, cooled and then returned back into this zone.

An apparatus for heat generation of the present invention, comprises a vessel or container with means assuring results of the pulsed optical radiation on the working fluid. To achieve the above-mentioned technical results in the apparatus of the present invention, the container or vessel is filled with a polar working fluid. A light-reflecting screen or surface made of a material wettable by the working fluid or having a coating of this material is positioned within the polar working fluid. A source of pulsed optical radiation is provided to irradiate the working fluid in the zone of it's contact with the surface of the light-reflecting screen located in the fluid.

As a result of the pulsed light radiation, the apparatus of the invention is not only capable of separation of the immobile molecules of the working fluid from the surface of the light-reflecting screen, but it can also replenish mobile molecules of the working fluid.

To achieve simultaneous irradiation of a large volume of the working fluid, the source of pulsed light radiation can be extended through the working chamber.

In order to improve intensity of action on the working fluid, the light-reflecting screen or surface situated within the fluid can be formed as a wall of the working chamber embracing the extended source of pulsed light radiation. The working chamber communicates with part of the system situated outside of the vessel or container. This enables the invention to replace the working fluid situated in the space between the source of pulsed optical radiation, and the light-reflecting screen by the fluid from the space external to the light-reflecting screen.

The apparatus for heat generation of the invention comprises a vessel having a working chamber formed with an interior thereof. A flow of working polar fluid passes through the working chamber. A source of pulsed light is provided within the working chamber. A light-reflecting surface or arrangement is wettable by the working fluids. A thermal energy is released into the working polar fluid by pulsed light irradiation of the working fluid in the vicinity of the light-reflecting surface or arrangement. The released thermal energy is continuously removed from the working chamber by the flow of working fluid. The light reflecting arrangement may include a layer of light-reflecting material semi-transparent to the pulsed light. The layer is situated at an exterior of the source of pulsed light and the light-reflecting surface is spaced from the source.

In a further embodiment of the invention, the working polar fluid is directed tangentially to an inner surface of the working chamber, so as to, provide a circular motion of the working polar fluid within the interior thereof.

In another embodiment of the invention, the light-reflecting arrangement consists of a base and a plurality of blade-shaped members extending outwardly therefrom. The base and blade-shaped members are independently rotated so as to provide a circular motion of the working polar fluid within the working chamber.

BRIEF DESCRIPTION OF THE DRAWINGS

The various objects, advantages and novel features of the present invention will be more readily apparent from the following detailed description when read in conjunction with the appended drawings, in which.

DETAILED DESCRIPTION OF THE PREFERRED EMBODIMENTS

Figure 1:
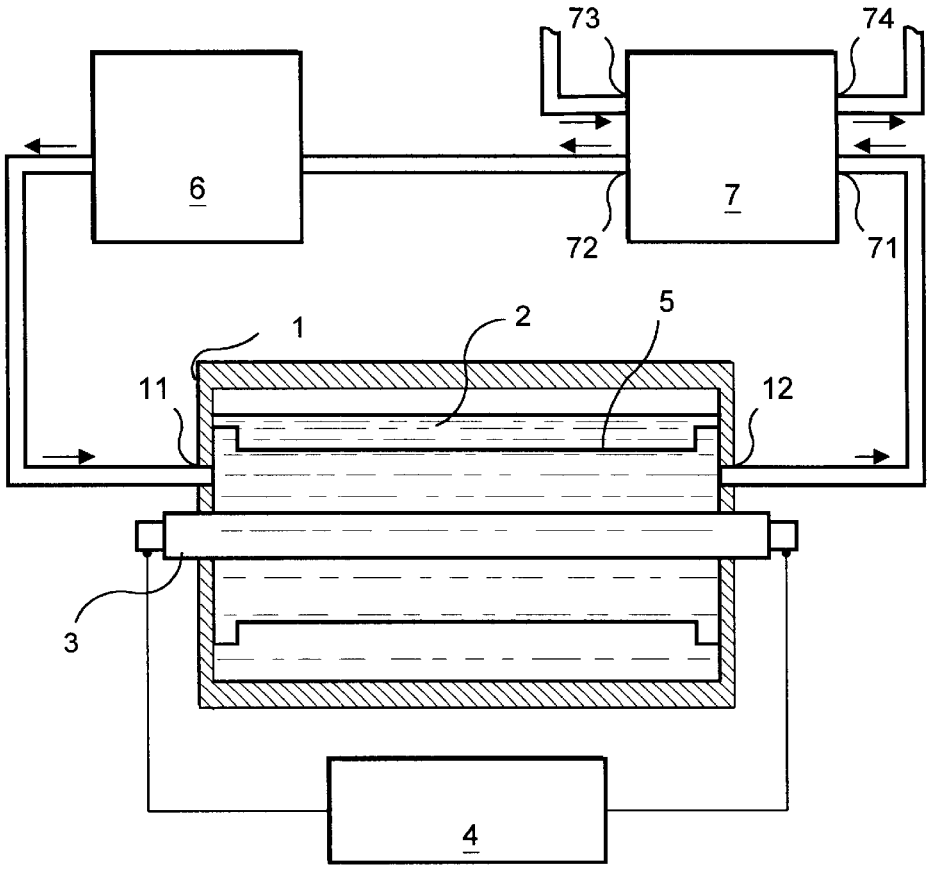
FIG. 1 illustrates a cross-sectional view of an apparatus for heat generation, of the present invention.

Referring to FIG. 1, an apparatus of the invention is formed by a container or vessel 1 having a working chamber filled with a working polar fluid 2. A source of pulsed light or pulsed light radiation 3 is located within the working fluid. In the embodiment shown in FIG. 1, a flash lamp or a high power gas-discharge tube is utilized as the source of pulsed light radiation. The flash lamp 3 extends longitudinally within the container also including a light reflecting screen or surface 5 which substantially surrounds the flash lamp. In the embodiment of FIG. 1 the longitudinal dimensions of the flash lamp 3 at least ten times exceed the transverse dimensions thereof. The flash lamp 3 is connected to a source of pulse voltage 4. Although a specific source of pulsed light or pulsed light radiation has been described, it should be understood that any source of pulsed light or light radiation is within the scope of the invention.

The container or vessel 1 is formed with an inlet port 11 and an outlet port 12, adapted for connection of the vessel to a pumping arrangement 6 and a heat exchanger 7, so as to define a closed-loop or semiclosed-loop system for the working fluid. The heat exchanger 7 includes an inlet port 71 and an outlet port 72 also forming a part of the system. The working fluid is fed into the working chamber through an inlet port 73 of the heat exchanger and is removed from the working chamber of the system and supplied to a consumer through an exit port 74 of the heat exchanger. The pumping arrangement 6 is provided with a conventional or an electric drive (not shown in FIG. 1).

Figure 2:
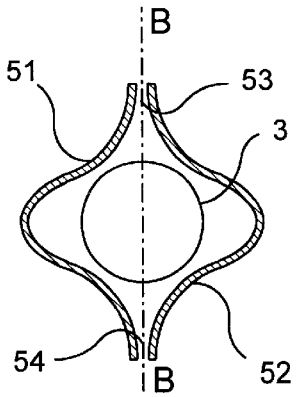
FIG. 2 illustrates an embodiment of a light-reflecting screen formed as a wall of a chamber and composed of two parts.
Figure 3:
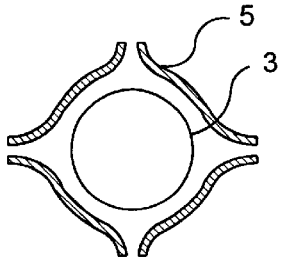
FIG. 3 illustrates an embodiment of the light-reflecting screen composed of four parts.

Referring now to FIG. 2 which is a sectional view further illustrating the light-reflecting surface or screen 5 and the flash lamp 3. The light-reflecting surface or screen 5 is formed by an inner wall of the working chamber embracing the flash lamp 3. In the embodiment of FIG. 2, the screen 5 is made of two substantially similar parts 51 and 52 situated symmetrically about a longitudinal axis A—A of the flash lamp 3. The parts 51 and 52 are also symmetrical about a plane passing through a vertical axis B—B of FIG. 2. The inner areas of the parts 51 and 52 of the screen facing the flash lamps are formed with developed mirror surfaces. Such mirror surfaces can be formed having a corrugated or saw-toothed configuration. As illustrated in FIG. 2, the first 51 and second 52 parts of the chamber wall forming the light-reflecting surface or screen 5 can be fairly curved towards each other so as to form between edges thereof slots 53 and 54 having a cross section resembling a contracting nozzle profile. FIG. 3 illustrates an embodiment of the light-reflecting surface or screen 5 composed of four substantially similar parts.

Figure 4:
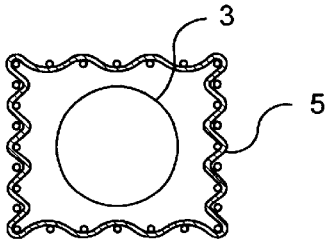
FIG. 4 illustrates another embodiment of the light-reflecting screen, made of a grid forming in cross section a closed loop in the form of a rectangle.
Figure 5:
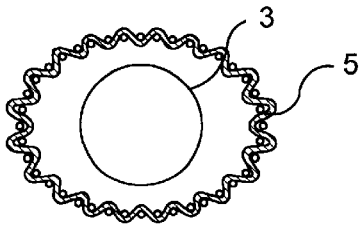
FIG. 5 illustrates an embodiment of the invention similar to that of FIG. 4 with the closed loop having an elliptical configuration.

As depicted in FIGS. 4 and 5, the light-reflecting screen 5, can be formed as a wall of a chamber completely surrounding the flash lamp 3. In this embodiment the wall of the chamber is made as a net or grid from a material having a mirror-like surface. The cross section of the chamber may resemble a rectangle or ellipse.

The working fluid utilized by the invention is a polar fluid or polar dielectric having molecules formed as elementary electrical dipoles. The polar dialectics are also known as a dialectics with molecules (atoms) positioned asymmetrically relative to their nucleus. The container 1 is filled with a polar liquid capable of wetting the surface of the light-reflecting screen 5. In the case of a silver or silver-plated screen such conditions are satisfied by utilizing such working polar fluids as water, alcohol and a number of other liquids. In all embodiments of the light-reflecting screen of the invention, the apparatus of the invention operates in a similar manner and depends on the following physical phenomena and properties of polar liquids.

It is known that the liquid phase of water contains varying aggregates of molecules or clusters [see, Clifford E. Swartz, Unusual Physics of Usual Phenomena, Moscow, Science Publishing, 1986]. The emergence of clusters is caused by the polar properties of water. In view of these properties separate molecules and groups of molecules come into electrical interaction making the presence of clusters inherent in to many polar liquids.

Clusters are continuously composed and breaking apart. The formation of the clusters is accompanied by energy release. In the present invention, the rate of cluster formation often exceeds the rate of their breaking. As a result of a non-elastic collision of two constituents , either individual molecules and/or clusters developed earlier, formation of new clusters takes place in the presence of a third particle in the collision zone. The rate of cluster formation is determined by the concentration of such third particles. The probability of triple collisions is the greatest when the third particles are slow-moving ones. Such slow-moving particles are those just vacated the surface of the screen positioned within the working fluid and still situated in the proximity of the surface of the screen. Fluid molecules situated in the vicinity of the screen surface are affected by the cohesive forces (i.e., forces directed from other molecules of the working fluid) and adhesive forces (i.e., the forces of interaction with a screen material). The cohesive and adhesive forces usually act in opposite directions. This is specifically so in the case of working fluid capable of wetting the screen surface. The wetting further provides constant presence of the molecules of the working fluid on the screen surface. As a result of minor forces exerted on such molecules and their losing contacts with the screen surface, these molecules are ready and capable of passing to a free state.

In the embodiment of the apparatus depicted in FIG. 1, formation of clusters occurs in the vicinity of the surface of the screen and takes place upon action of the pulsed light radiation generated by the flash lamp 3 on the working fluid 2. To increase the effectiveness of this action by the pulsed light radiation, the surface of the screen 5 is made from light-reflecting material and/or formed with a mirror-type coating. The molecules of working fluid lose contact with the surface of the light-reflecting screen 5 under the action of quanta of light radiation. Quantity of the released molecules depends on the material of the light-reflecting screen 5. Specifically, such quantity depends upon the properties which define the magnitude of adhesive forces for the molecules of a specific working fluid. For example, in the case of a silver or silver-plated screen and water used as the working fluid, the magnitudes of adhesive and cohesive forces are substantially balanced. Therefore, the process of releasing the molecules from the surface of the screen occurs under lower energy of the light pulse. The released molecules facilitate development of molecular formations. A new molecular formation operates in an excited state and, after multiple collisions, transfers own oscillatory energy to other molecules of the working fluid. Energy liberated in the course of formation-development is adapted by the molecule released from the surface of the light-reflecting screen 5 and present in the collision zone. As a result of such collisions, this energy is transferred to other molecules. Upon the action of the light pulse, a certain quantity of working fluid or water leaves the area in the vicinity of the light-reflecting screen 5. This portion of working fluid or water is replaced by a new portion of working fluid or water from a chamber space surrounding the flash lamp 3 having a wall formed as the light-reflecting screen 5. Hereinafter, this process is repeated over and over.

When the working fluid 2 is stationery, its temperature rises to reach a heat balance with the surrounding environment. Such balance is reachable if it is possible, under specific conditions, to transfer heat to the surroundings. otherwise, a further elevation of the working fluid temperature occurs and, upon transition of a part of fluid to a gaseous phase, operation of the apparatus is interrupted.

The loss of contact between the molecules of liquid and the surface of the screen takes place as a result of irradiation of the polar working liquid by the pulsed light radiation in the area of contact between the liquid and the screen. The released molecules of liquid enable the invention to form the clusters of molecules. This Process is accompanied by an additional release of heat or thermal energy into the liquid.

The energy in the range of $10^{-20}$ J and the density of the optical radiation energy on the screen of no less then 1 J/m$^2$ is necessary for the removal of the molecules of liquid from the surface of the screen. Such density can be provided by, for example, a source of pulsed light radiation having the energy 100 J with the duration of impulse $10^{-2}$ sec and power $10^6$ W. Within certain time after separation of the molecules from the wetted screen a layer of the particles of liquid capable of repeating the process is formed on the screen. Such process can be continued until it is possible to form clusters of the molecules within the liquid. Upon reaching a saturation point it is recommended to replace the working liquid. For maximizing the release of the energy, the initial quantity of the clusters of molecules in the working liquid should be minimal.

To efficiently participate in the triple collision and particle formation process the time of removal of the molecules of the working fluid from the light-reflecting screen should be minimized. In the invention, this is achieved by utilizing the sources of pulsed light radiation generating pulses of the light radiation having limited duration.

When the pumping means 6 is in use and heat is removed from of the heated working fluid in the heat exchanger 7 (for example, of a recuperative type), a heat balance is achieved at a lower temperature of the working fluid in the vessel 1. In the invention, operation of the apparatus with the high efficiency release of thermal energy (relative to the quantity of the overall initially delivered energy necessary for running the process of heat generation) takes place until a change in the properties of the working fluid circulated within the hydraulic closed-loop system occurs. As a result of such changes, the ability to form clusters with the release of energy is terminated. At this point the working fluid should be replaced.

The invention represents an arrangement for the conversion of the potential energy of the working fluid into the kinetic energy of its molecules resulting in the temperature elevation of the working fluid. The quantity of potential energy converted into the kinetic energy is defined by the concentration of clusters or free molecules capable of participating in the formation process.

The apparatus of the present invention can also form a part of a hydraulic semiclosed-loop system having in addition to the above discussed elements, a separating arrangement or a liquid separator. The main function of the liquid separator (not shown) is to separate a processed working polar liquid from the working polar liquid before the process of irradiation by the pulsed light. During this process, the clusters of molecules or formations are separated. The stream of such clusters is directed to the area of the chamber having the most favorable conditions for the formation process. Then, the processed working liquid is removed from the circuit and is replaced by the fresh working liquid. The operation of the separating arrangement can be based on electrostatic, magnetic, electromagnetic, and hydraulic principles.

In the experimental studies of the method and apparatus of the present invention, water was used as a working fluid. The thermal energy was generated within a wide range of pulses light radiation. The duration of the pulse was within the range of 1–5.10 microsec. with the pulse recurrence of frequency from 0.01 to 100 Hz. Industrial flash gaseous discharge lamps of visible light radiation spectrum were used as the sources of pulsed lights radiation. In order to generate the thermal energy exceeding in quantity the energy consumed during the process (with a limited amount of the consumed energy) it is necessary to experimentally select the power of the source of light radiation. The selection depends on specific structural parameters of the apparatus and operating conditions thereof, such as: the volume of the working fluid in the vessel; configuration and dimensions of the flash lamp; the distance from the flash lamp to the light-reflecting screen, the fluid circulation rate; cooling conditions; etc. In the conducted experiments the light radiation density in the range of $10^{-4}$–1 J/mm$^2$ at the light-reflecting screen corresponded to the required radiation power.

The Table presented hereinbelow contains results of the experiments illustrating generation of the thermal energy in the apparatus of the invention.

The molecules of liquid in the excited condition are developed in a part of the working liquid removed from the circuit. It is expected that the working liquid removed from the circuit should have a high level of biological activity and should favorably affect the cells of live organisms. Seeds of vegetables and nursery flowers were used during investigation of the biological activity of the working polar liquid removed from the circuit of the invention. The seeds were separated into two groups. Ordinary water was applied to the first group, whereas the working water removed from the apparatus of the invention was utilized in the second group. According to this experiment, the rate of growth of seeds treated by the water removed from the circuit was 1.5–2 times greater compared to the seeds treated by the ordinary water. The nursery flowers treated by the water from the circuit bloomed significantly earlier than the nursery flowers treated by the ordinary water. It is expected that water from the circuit should favorably affect human skin and can be used for treatment of dermatological diseases.

Under certain conditions, it is possible to accelerate and enhance the process of cluster formation in the polar fluid such as water. This can be carried out by generating in the polar liquid of special molecules or light fluid molecules capable of being removed from a wettable reflective surface by light irradiation. The energy released in the process of cluster formation of fluid molecules is removed or absorbed substantially by these liquid molecules. Therefore, the efficiency of the apparatus for heat generation is substantially dependent on the specific concentration of light molecules in the working fluid. It is also dependent upon the efficiency of the removal of high energy light molecules for subsequent heat utilization.

Referring now to FIGS. 6–9, wherein, further embodiments of the apparatus for continuous heat generation of the invention are illustrated. These embodiments enable the invention to increase the specific concentration of light molecules in the working fluid as well as to efficiently remove heat generated by the apparatus for further utilization.

Figure 6:
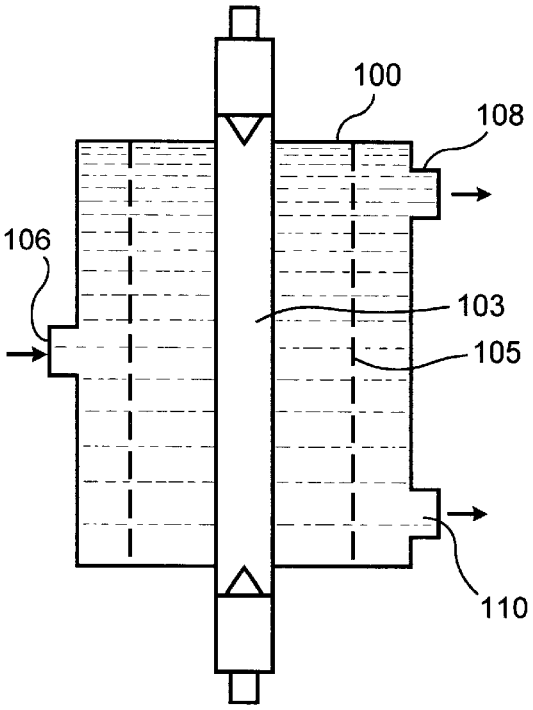
FIG. 6 illustrates another embodiment of the invention having substantially vertical orientation of the impulse light source and wettable reflective surface.

Among essential elements of the apparatus illustrated in FIG. 6 are: a working vessel 100, an impulse light source 103, and a wettable reflective surface 105. For the purpose of simplicity in FIGS. 6–9, the arc of the source of pulsed light or a discharge pulse lamp is considered to be substantially equal to the height of the vessel. However, it should be understood that such arc can be shorter or longer than the height of the vessel.

The apparatus is formed having substantially vertical orientation of the reflective surface 105 and the impulse lamp 103. The reflective surface 105 can be formed by positioning of a wettable light reflective layer on the inner surface of the working chamber. In the embodiment of FIG. 6 the working fluid enters the vessel 100 and its interior working camber through the inlet 106 and exits the vessel through the outlets 108 and 110 situated in the upper and lower parts thereof. According to the conducted experiments, the maximum temperature of the working fluid or polar liquid is situated in the area positioned between 0.8–0.9 of the height of the vessel or 0.8–0.9 length of the arc of the discharge pulse lamp.

Figure 6A:
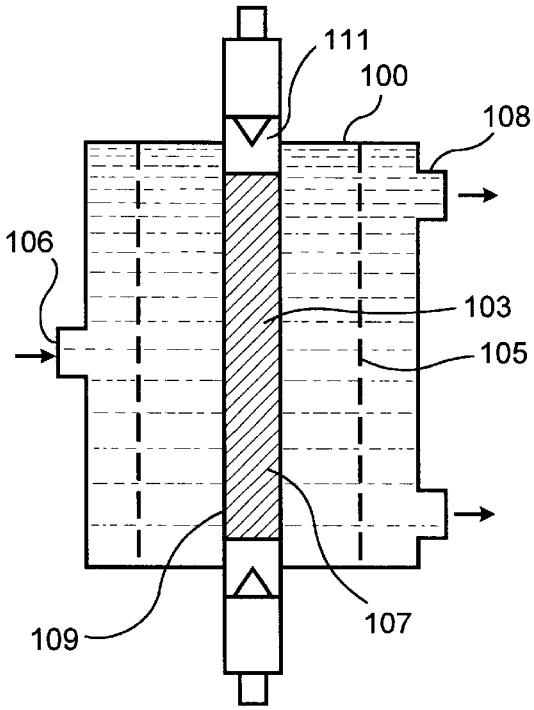
FIG. 6A illustrates a further embodiment of the invention in which a light-reflecting arrangement includes a light-reflecting layer on the source of pulsed light and a light-reflecting surface spaced from the source.

An embodiment of the apparatus of the invention illustrated in FIG. 6A is in some respects similar to that of FIG. 6. The apparatus of FIG. 6A is formed with a light-reflecting arrangement 109 wettable by the working polar fluid. The light-reflecting arrangement consists of a layer 107 of a light-reflecting material semitransparent to the pulsed light and a light-reflecting wettable surface 105. The layer 107 is situated on an exterior surface 111 of the source of pulsed light 103. The layer 107 is transparent to the pulsed light irradiation only in one direction, i.e. in the direction from the source of pulsed light 103 towards the light reflecting surface 105. The exterior of the layer 107 is formed having light-reflecting qualities and is wettable by the working polar fluid.

Although, one source of pulsed light 103 having the layer of light-reflecting material is illustrated in FIG. 6A, positioning of a plurality of such sources within the working chamber is also contemplated. This arrangement enables the invention to further increase the specific concentration of the light molecules within the chamber.

Figure 7:
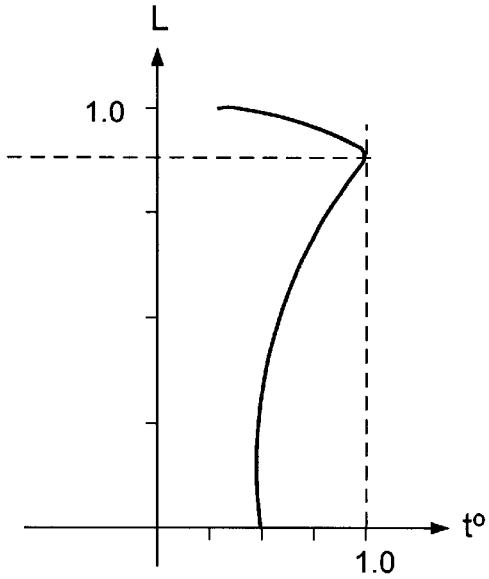
FIG. 7 is a chart illustrating correlation between the temperature of working fluid and the height of the vessel length of the arc of the discharge pulse lamp.

FIG. 7 is a chart which illustrates correlation of the working fluid temperature and the height of the vessel or length of the arc of the discharge pulse lamp. According to the chart, when the number of pulses are about 30, the pulse energy is in the area of 100 Joules, the pulse width is approximately 300 microseconds and the volume of the working fluid is about 300 grams. In this condition, the maximum temperature of the working fluid is at the predetermined depth at the upper region of the vessel. Removal of the heated fluid through the opening 108 located at the upper part of the vessel (see FIGS. 6 and 6A) provides the most efficient utilization of the generated heat. The heavy clusters of fluid molecules are removed through the lower output openings 110.

Figure 8:
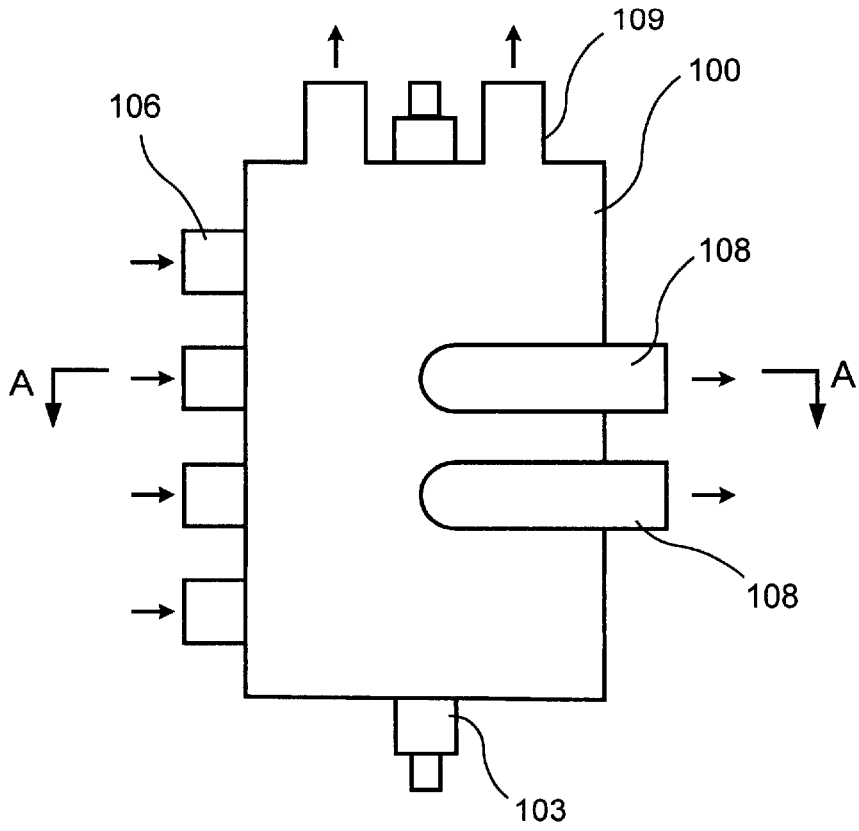
FIG. 8 illustrates an embodiment of the invention with angential input of the fluid.
Figure 8A:
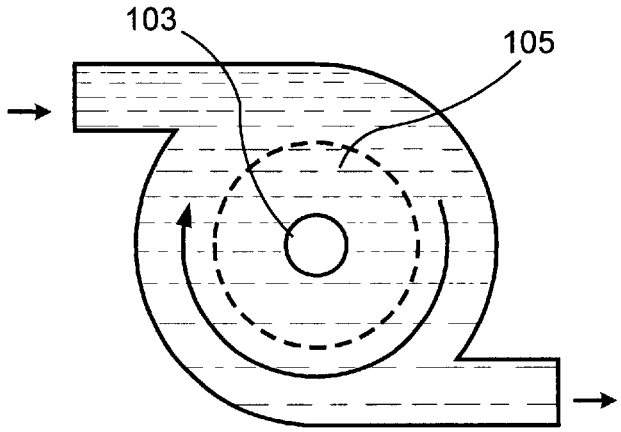
FIG. 8A is a cross-section according to section line A—A of FIG. 8.

FIG. 8 illustrates the apparatus of the invention having the vessel 100 with the impulse light source 103 and wettable reflective surface 105. As clearly illustrated in FIG. 8A, in this embodiment the working fluid enters the vessel or the working chamber in the direction tangential to inner surfaces thereof. This results in a circular motion of the working fluid within the vessel or the working chamber. Such circular motion facilitates separation of clusters of the working fluid molecules depending on their sizes.

The light clusters having higher energy are concentrated in the center of the vessel, whereas the heavier clusters with lower temperature and energy are positioned at the outer periphery of the vessel or the working chamber in the vicinity of the inner surfaces. Thus, the heavy clusters or spent clusters of molecules are removed through the outlets 108, whereas the light clusters having high temperature are utilized either directly or by means of heat exchangers. The light clusters typically exit the working chamber through the outlets 109 situated within the upper region of the vessel.

Figure 9:
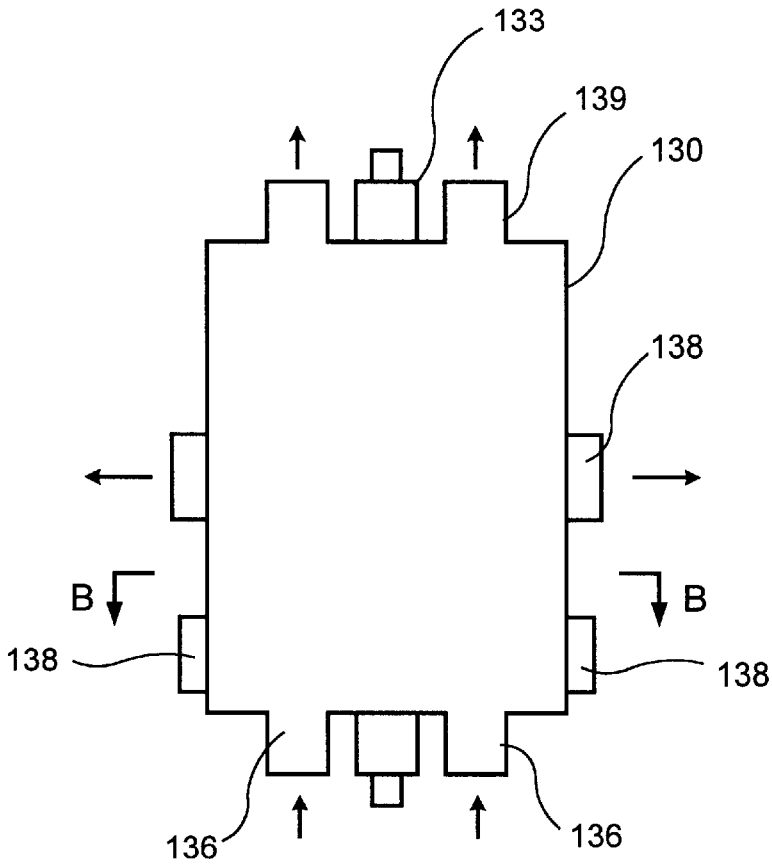
FIG. 9 illustrates an embodiment of the invention having the reflective surface is in the form of blade-shaped members.
Figure 9A:
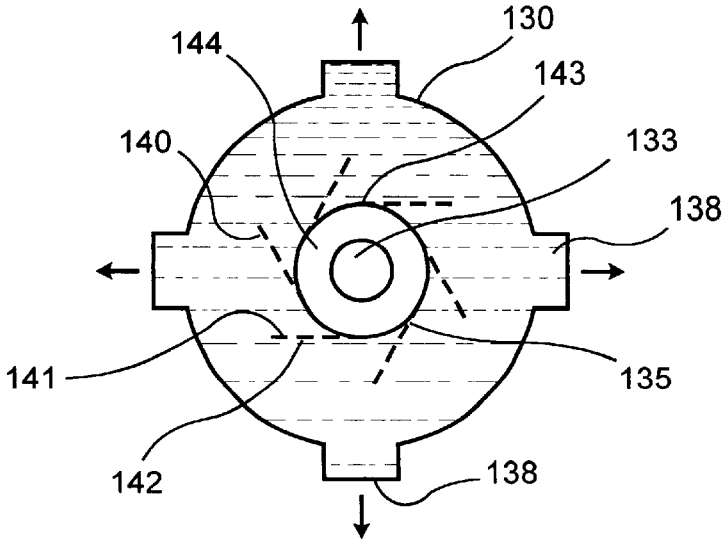
FIG. 9A is cross-section according to section line B—B of FIG. 9.

Another embodiment of the apparatus of the invention, having vertical orientation of the impulse light source is best illustrated in FIGS. 9 and 9A. The vessel 130 is typically formed with a body having substantially cylindrical configuration with the impulse light source 133 extending through its central region. A wettable reflective arrangement 135 consists of a base 143 and a plurality of reflective blade-shaped members 140 extending outwardly therefrom. Each blade-shaped member 140 is formed with at least one reflective surface. However, in the preferred embodiment, each blade-shaped member 140 is formed with two reflective surfaces 141 and 142 positioned opposite each other. The reflective arrangement 135 is independently rotatable, so as to form a circular motion of the polar fluid within the vessel or within the working chamber. As illustrated in FIG. 9, the impulse light source 133 is surrounded by the reflective arrangement 135.

The blade-shaped members 140 can be fixedly connected to the base 143. In an alternative embodiment of the invention, the blades 140 are movable with respect to the base. In this respect, the blades can be pivotably connected by any conventional means to the exterior of the base 143. The shape of the blades and the angle between the blades and the base are selected to provide the most efficient generation of light molecules.

The working fluid enters the vessel 130 through the inlets 136 positioned at the bottom portion thereof. The heavy or spent clusters are removed from the vessel through the outlets 138 positioned circumferentialy throughout the vessel and distributed between the central and lower portion thereof. The light clusters are discharged through the outlets 139 situated at the upper portion of the vessel. Although, in the preferred embodiment of the invention, the outlets 139 should correspond to the space 144 between the vertically oriented source of impulse light 133 and the base 143 of the reflective arrangement 135, positioning of the outlets 139 through the entire upper portion of the vessel 130 is also contemplated.

In this embodiment, independent rotation of the reflective arrangement 135 is resulted in the corresponding movement of the working fluid within the vessel and ultimately results in the separation of clusters of fluid molecules according to their size. This occurs in the manner similar to that of the embodiment of FIG. 8.

In the embodiment of FIGS. 9 and 9A, the working fluid enters the vessel 130 along its longitudinal axis. During the removal of the working fluid from the vessel, the heavy particles are discharged radially through the outlets 138, whereas the light particles are removed in the axial direction through the outlets 138. The temperature of the discharged light particles is higher than the temperature of the discharged heavy particles. The generated heated fluid can be utilized in the manner similar to the above discussed embodiment of FIG. 8.

The polar fluid entering the vessel can contain the molecular formation of various sizes. There is a correlation between the sizes of the particles and the temperature of the working fluid. The working fluid having the temperature close to the temperature of freezing corresponds to greater sizes of the molecular formations and the lower quantity thereof. This is an indication of lower energy input in the cluster formation process. On the other hand, when the temperature of working fluid approaches the boiling point, the quantity of slower elements in the fluid capable of activating the process of cluster formation is also reduced. Thus, the maximum energy in the cluster formation process corresponds to the temperature of working fluid between the temperature of freezing and the temperature of boiling.

In the embodiments of the invention illustrated in FIGS. 6–9, the working fluid removed from the vessel can be further utilized either directly as heated fluid or through transformation of its heat into other forms of energy in the independent energy exchanges.

The invention in its broader aspects is not limited to the specific details, and various changes and modifications obvious to one skilled in the art to which the invention pertains are deemed to be within the spirit, scope and contemplation of the invention as further defined in the appended claims.

What is claimed is:

1. An apparatus for heat generation, comprising:

a vessel, said vessel having a working chamber formed within an interior thereof;

a flow of working polar fluid passing through said working chamber;

a source of pulsed light within said working chamber, said source of pulsed light extends longitudinally within said working chamber; and a light-reflecting surface wettable by said working fluid within the working chamber, said light-reflecting surface is positioned in the vicinity of said source of pulsed light and spaced from the interior of the working chamber;

whereby a thermal energy is released into said working polar fluid by pulsed light irradiation of said working fluid in the vicinity of said light-reflecting surface, said released thermal energy being continuously removed from said working chamber by said flow of working fluid.

2. The apparatus of claim 1, wherein said light-reflecting surface substantially surrounds said source of pulsed light.

3. The apparatus of claim 1, wherein the working polar fluid exits said vessel through a plurality of outlets situated at an upper and lower parts thereof.

4. The apparatus of claim 1, wherein said flow of working polar fluid is directed tangentially to an inner surface of said working chamber, so as to form a circular motion of the working polar fluid within said working chamber.

5. The apparatus of claim 4, wherein said circular motion of the working polar fluid results in separation of clusters of the working fluid molecules in such a manner that lighter clasters of molecules having higher temperature are concentrated at a center of the working chamber and heavier clusters of molecules with lower temperature are positioned at an outer periphery of the working chamber.

6. The apparatus of claim 5, wherein said heavier clusters of molecules are removed from said vessel through a plurality of outlets extending from a central to a lower part of the vessel.

7. The apparatus of claim 6, wherein the lighter clusters of molecules are removed from said vessel through outlets provided at the top part of the vessel.

8. The apparatus of claim 1, wherein said light reflecting surface is in the form of a light reflecting arrangement consisting of a base and a plurality of blade-shaped members extending outwardly therefrom.

9. The apparatus of claim 8, wherein said base and blade-shaped members are independently rotated so as to form a circular motion of the polar fluid within the chamber, said base is spaced from and surrounds said source of pulsed light.

10. The apparatus of claim 9, wherein each said blade-shaped member is formed with at least one light-reflecting surface.

11. The apparatus of claim 10, wherein each said blade-shaped members is formed with two light-reflecting surfaces positioned opposite each other.

12. The apparatus of claim 9, wherein said blade-shaped members are fixedly connected to an exterior portion of the base.

13. The apparatus of claim 11, wherein each said blade-shaped member is movably connected to an exterior of the base.

14. The apparatus of claim 9, wherein the high energy clusters of molecules concentrated at the center of the working chamber are removed through an outlet provided at a top portion of the vessel.

15. The apparatus of claim 2, wherein said light-reflecting surface is substantially cylindrical.

16. The apparatus of claim 2, wherein said light-reflecting surface is substantially elliptical in crossection.

17. An apparatus for heat generation, comprising:

a vessel, said vessel having a working chamber formed within an interior thereof;

a flow of working polar fluid passing through said working chamber;

a source of pulsed light within said working chamber;

a light-reflecting arrangement wettable by said working fluid, said light-reflecting arrangement including a layer of a light-reflecting material semitransparent to said pulsed light, said layer being situated at an exterior of the source of pulsed light and a light-reflecting surface spaced from said source;

whereby a thermal energy is released into said working polar fluid by pulsed light irradiation of said working fluid in the vicinity of said light-reflecting arrangement, said released thermal energy being continuously removed from said working chamber by said flow of working fluid.

18. The apparatus of claim 17, wherein said layer is transparent to said pulsed light irradiation in the direction from said source of pulsed light toward said light reflecting surface, an exterior of said layer being light-reflective and wettable by said working fluid.

19. An apparatus for heat generation, comprising:

a vessel, said vessel having a working chamber formed within an interior thereof;

a flow of working polar fluid passing through said working chamber, a source of pulsed light within said working chamber, said source of pulsed light extends longitudinally within said working chamber; and a light-reflecting surface wettable by said working fluid within the working chamber, said light-reflecting surface is positioned in the vicinity of said source of pulsed light and forms a part of the interior of the working chamber; whereby a thermal energy is released into said working polar fluid by pulsed light irradiation of said working fluid in the vicinity of said light-reflecting surface, said released thermal energy being continuously removed from said working chamber by said flow of working fluid.

* * * * *